United States Patent [19]

Wührer

[11] Patent Number: 4,509,925

[45] Date of Patent: Apr. 9, 1985

[54] MARINE VESSEL PROPELLER WITH NOZZLE

[75] Inventor: Wolfgang Wührer, Ravensburg, Fed. Rep. of Germany

[73] Assignee: Sulzer-Escher Wyss GmbH, Ravensburg, Fed. Rep. of Germany

[21] Appl. No.: 496,926

[22] Filed: May 23, 1983

[30] Foreign Application Priority Data

Jun. 1, 1982 [CH] Switzerland ..... 3352/82

[51] Int. Cl.[3] ..... B63H 5/14

[52] U.S. Cl. ..... 440/67; 440/47; 440/50

[58] Field of Search ..... 440/66, 67, 50, 47; 416/93 A, 93 R, 215; 415/196, 201, 500, DIG. 3

[56] References Cited

U.S. PATENT DOCUMENTS

| | | | |
|---|---|---|---|
| 1,600,654 | 9/1926 | Stodder | 416/140 |
| 1,714,917 | 5/1929 | Martin | 440/67 |
| 3,756,741 | 9/1973 | Woell | 415/196 |
| 3,938,463 | 2/1976 | Hecker | 440/50 |
| 3,967,573 | 7/1976 | Charles | 440/50 |
| 4,046,096 | 9/1977 | Liaaen | 440/50 |

FOREIGN PATENT DOCUMENTS

| | | | |
|---|---|---|---|
| 2103568 | 1/1972 | Fed. Rep. of Germany . | |
| 456431 | 8/1913 | France | 440/67 |

*Primary Examiner*—Sherman D. Basinger
*Attorney, Agent, or Firm*—Werner W. Kleeman

[57] ABSTRACT

The marine vessel propeller has vanes or blades containing outer edges which are bounded by circularly domed outer surfaces which coact with a spherical zone of a spherical surface formed at the inner surface of the nozzle. The common central point of the spherical zone and of the circularly domed outer surfaces of the vanes or blades is located at the intersection point of the vane axes and about each of which vane axis the related propeller vane or blade is pivotable. The intersection point of such vane axes is located on the propeller axis.

18 Claims, 3 Drawing Figures

MARINE VESSEL PROPELLER WITH NOZZLE

BACKGROUND OF THE INVENTION

The present invention relates to a new and improved construction of marine vessel propeller equipped with a nozzle and comprising propeller vanes or blades, each of which defines a vane or blade axis about which the corresponding vane is pivotable. The vane axes intersect at an intersection point which is located on the propeller axis.

In known marine vessel propellers of this type a minimum gap formed between the outer edges of the vanes or blades and the inner surface of the nozzle only can be maintained at one single position of the vanes or blades, namely, at the region of an angle of attack having a value of zero at which no driving force exists. In the operative position and with a large angle of attack at which high efficiency has to be attained wedge-shaped expanding or widening gaps are formed between the ends of the vanes or blades and the inner surface of the nozzle which decrease the efficiency of the propeller-nozzle unit. Furthermore, there exists the danger that foreign bodies can enter the wedge-shaped gap between the end of one of the vanes or blades and the inner surface of the nozzle and which may damage the propeller vane or blade.

SUMMARY OF THE INVENTION

Therefore, with the foregoing in mind it is a primary object of the present invention to provide a new and improved construction of marine vessel propeller with nozzle designed to achieve optimum efficiency.

Another important object of the present invention is directed to the provision of a new and improved marine vessel propeller with nozzle in which the danger of damage to the propeller vanes or blades by foreign bodies like, for example, pieces of ice at ice-breaking propellers is appreciably reduced.

Now in order to implement these and still further objects of the invention, which will become more readily apparent as the description proceeds, the marine vessel propeller of the present development is manifested by the features that, in the dynamic state, that is during rotation of the vanes about the propeller axis, the outer edges of the vanes are bounded or limited by domed outer surfaces substantially forming portions of a spherical surface, the central point or center of which is located at the intersection point of the vane axes. Moreover, the inner surface of the nozzle is provided with a spherical zone having a central point or center also located at the intersection point of the vane axes and possessing a radius which is larger than the radius possessed by the spherical surface of the vanes in order to form a predetermined gap. The spherical zone extends upstream and downstream of a circular intersection line formed by the intersection of a surface described by the vane axes during rotation of the vanes about the propeller axis, and the ends of the outer surfaces of the vanes coincide with the margins or outer regions of the spherical zone at the largest vane angle or attack.

The marine vessel propeller of the present development is manifested under static conditions, i.e. when the propeller vanes or blades are stationary, by the features that, the outer edges of the vanes or blades are bounded or limited by domed outer surfaces substantially forming portions of a spherical surface, the central point or center of which is located at the intersection point of the vane axes. Moreover, the inner surface of the nozzle is provided with a spherical zone, the central point or center of which also is located at the intersection point of the vane axes and the radius of which is greater than the radius of the outer surface of the vanes in order to form a predetermined gap. The spherical zone extends upstream and downstream of intersection points formed by the intersection of the vane axes with the spherical zone when the propeller is stationary, and the ends of the outer surfaces of the vanes coincide with the margins or outer regions of the spherical zone at the largest vane angle of attack.

By these measures there is achieved the beneficial result that at all angular positions of the propeller vanes or blades the gap or space formed between the outer edges of the vanes or blades and the inner surface of the nozzle essentially remains the same size and thus may be at a minimum in all of the aforementioned positions. As a consequence thereof, an optimum efficiency is realized at all positions of the propeller vanes or blades. Additionally and due to the minimum size of the gap there is practically excluded the danger that foreign bodies can enter between the outer edges of the vanes or blades and the inner surface of the nozzle.

The circular-shaped or circularly domed design of the outer surfaces of the vanes or blades preferebly can form portions of a spherical surface, the central point or center of which is located at the intersection point of the vane axes. These measures provide for an optimum matching or accommodation of the outer surfaces of the vanes or blades to the spherical zone formed at the nozzle. However, it will be understood that the circularly domed outer surfaces may also each form, for example, just a narrow edge or part of a cylindrical surface.

Considered in the dynamic state, the spherical zone preferably extends downstream with a larger section thereof than upstream, from an intersection line formed by the spherical zone and the surface described by the vane axes during the aforementioned rotational movement. Equally, the spherical zone extends downstream with a larger section than upstream under static conditions, i.e. when the vanes are stationary, from the intersection points formed by the intersection of the spherical zone and the vane axes of the stationary vanes. By virtue of such design the flow through the nozzle is positively affected or enhanced by restricting or limiting an expansion of the flow at the region of the spherical zone.

It is also possible to arrange the propeller vanes or blades in such a way that under dynamic conditions, i.e. during rotation of the vanes about the propeller axis, the vane axes are inclined downstream and away from a plane extending normally or perpendicular with respect to the propeller axis and, under static conditions, i.e. when the vanes are stationary, the vane axes are inclined downstream with respect to the propeller axis. Due to such measures the flow conditions within the nozzle may be additionally improved by further restricting or limiting an expansion of the flow at the region of the spherical zone.

In a design as described hereinbefore, the inclination angle of the vane axes with respect to a plane extending normally or perpendicular relative to the propeller axis may be selected such that under dynamic conditions, i.e. during rotation of the vanes about the propeller axis, the upstream margin or outer region of the spherical zone is located at the region of a plane extending normally or perpendicular relative to the propeller axis and through the intersection point of the vane axes; it may be selected such that under static conditions, i.e. when the vanes are stationary, the upstream margin is located at the region of a line extending normally with respect to the propeller axis and through the intersection point of the vane axes. Due to such a design an expansion of the flow at the region of the spherical zone is totally prevented. The same effect can also be achieved when the inclination angle of the vane axes with respect to the plane extending normally or perpendicular relative to the propeller axis is selected such that under dynamic conditions, i.e. during rotation of the vanes about the propeller axis, the upstream margin of the spherical one is located upstream of a plane extending normally or perpendicular relative to the propeller axis and through the intersection point of the vane axes or, under static conditions, i.e. when the vanes are stationary, the upstream margin of the spherical zone is located upstream of a line extending normally or perpendicular with respect to the propeller axis and through the intersection point of the vane axes.

Preferably the length and the position of the spherical zone at the nozzle can be selected such that under dynamic conditions, i.e. during rotation of the vanes about the propeller axis, and under static conditions, i.e. when the vanes are stationary, the ends of the outer surfaces of the vanes or blades substantially coincide with the margins or outer regions of the spherical zone at the largest vane angle of attack. In this way optimum conditions are obtained for the coaction of the vanes or blades and the nozzle, on the one hand, and the spherical zone at the nozzle will be restricted to a minimum, on the other hand.

Optimum conditions for the coaction of propeller and nozzle will be obtained not only when the outer edges of the vanes or blades are machined but also when the spherical zone at the nozzle is machined.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
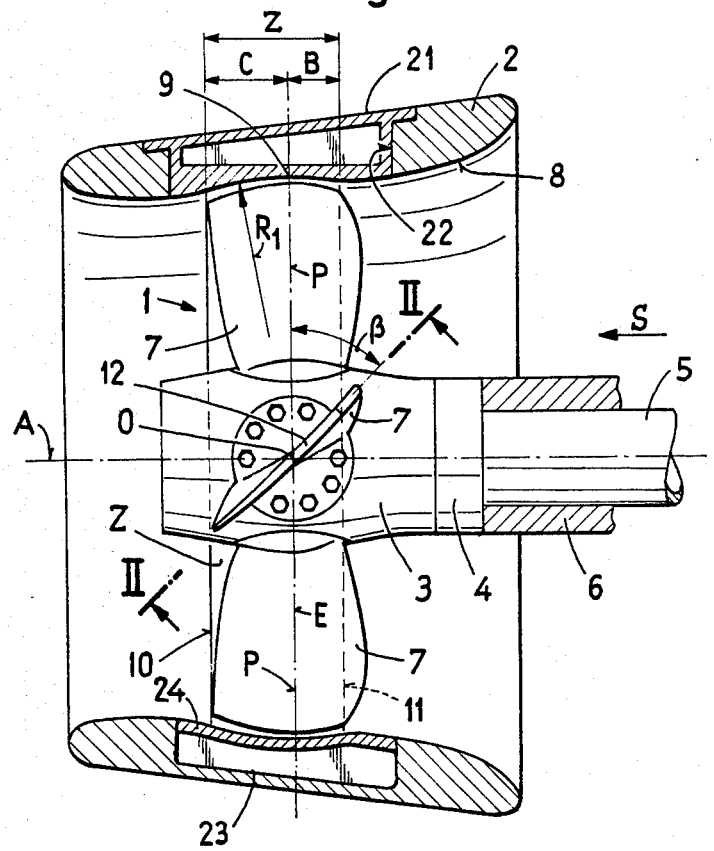
FIG. 1 illustrates a partial sectional view of part of a first embodiment of the marine vessel propeller with nozzle constructed according to the present invention.

Describing now the drawings, it is to be understood that only enough of the construction of the marine vessel propeller with nozzle has been shown as needed for those skilled in the art to readily understand the underlying principles and concepts of the present development, while simplifying the showing of the drawings. Turning attention now specifically to FIG. 1, there has been shown therein part of a marine vessel propeller 1 which is provided with a so-called Kort nozzle 2. The marine vessel propeller 1 includes a propeller hub 3 connected to a flange 4 of a propeller shaft 5 which is rotationally journaled in a bearing 6 arranged at the vessel hull (not shown) of the marine vessel. Propeller vanes or blades 7 are each conventionally mounted for pivotal movement about a vane axis P in a manner known as such in the hub 3. The propeller vanes or blades 7 are pivoted about the vane axes P by means of any suitable adjusting mechanism (not shown) which is known as such and which preferably is operated by an hydraulic pressure fluid medium which is supplied through the hollow propeller shaft 5.

As shown in FIG. 1, the nozzle 2 contains an inner surface 8 possessing an annular or ring-shaped spherical zone Z of a spherical surface, the central point or center 0 of which is located at the propeller axis A, namely at the point at which also the vane axes P of the propeller vanes or blades intersect. According to the illustration of FIG. 1, the spherical zone Z is laterally defined or bounded by two marginal or boundary lines 10 and 11 which, however, do not form sharp edges, but at which merge rounded transitional surfaces.

Figure 2:
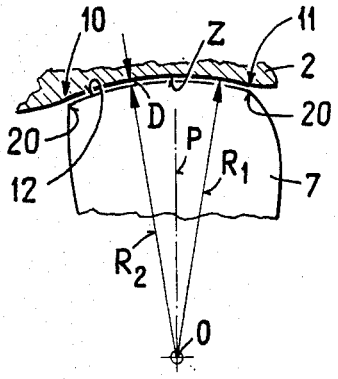
FIG. 2 is a partial sectional view taken substantially along the line II—II of FIG. 1.

As will be evident from FIG. 2, the spherical zone Z has a radius R1, while the outer surface 12 of the propeller vanes or blades 7 have a radius R2 which is smaller than the radius R1 by the width D of the gap or space formed therebetween. Depending upon the size of the propeller 1 and the strived for precision the gap width D may amount to a value of a few millimeters to a fraction of a millimeter.

When considering dynamic conditions, i.e. during rotation of the pivotal vanes or blades 7 about the propeller axis A the surface described by the vane axes P forms an intersection line 9 with the spherical zone Z in order to divide the same into two sections B and C, as will be seen in FIG. 1. With respect to the direction of flow as indicated by the arrow S the upstream section B is shorter than the downstream section C. As will also be evident from FIG. 1 and when considering static conditions, i.e. when the vanes or blades 7 are stationary, the spherical zone Z extends upstream and downstream of the intersection point formed by the vane axis P and the spherical zone Z.

Figure 3:
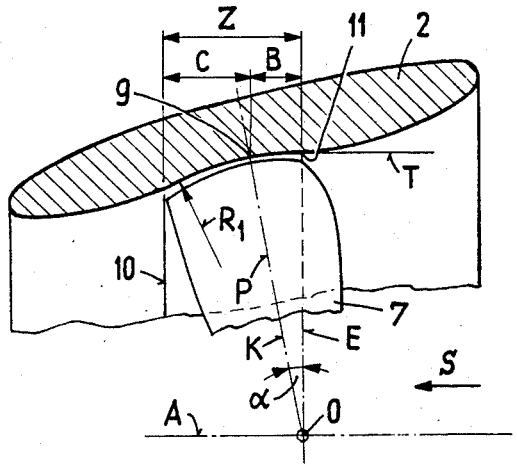
FIG. 3 shows a fragmentary section of a further embodiment of the marine vessel propeller with nozzle constructed according to the invention and corresponding to the showing of FIG. 1.

In the embodiment shown in FIG. 3, the vane axes P of the propeller vanes or blades 7 are inclined at an angle $\alpha$ in the flow direction S with respect to a plane E extending normally or perpendicular to the propeller axis A, as shown. Under dynamic conditions, i.e. during rotation of the vanes or blades 7 about the propeller axis A, the vane axes P describe a surface which is a conical surface K. Under static conditions, i.e. when the vanes or blades 7 are stationary, the vane axes P are inclined at the aforementioned angle $\alpha$ with respect to the normal plane E as shown in FIG. 3. The inclination angle $\alpha$ of the vane axes P of the propeller vanes or blades 7 is selected such that the upstream margin or edge 11 of the spherical zone Z at the nozzle 2 is located at the region of the plane E extending normally relative to the propeller axis A and through the intersection point O of the vane or blade axes P. Due to such design an expansion of the flow through the nozzle 2 at or after the margin 11 is avoided, since the tangent T to the spherical surface extends essentially parallel to the propeller axis A. However, it will be understood that still a greater angle $\alpha$ may be selected.

In all of the illustrated designs the axial length and the position of the spherical zone Z at the nozzle 2 is selected such that the ends 20 of the outer surfaces 12 of the vanes or blades 7 substantially coincide with the margins or boundary 10 and 11 of the spherical zone Z at the respectively illustrated largest vane angle of attack.

The inner surface 8 of the nozzle 2 is advantageously machined at least at the region of the spherical zone Z to obtain the smallest possible gap width D.

In FIG. 1 two possible measures for disassembling the propeller vanes or blades 7 are additionally illustrated.

Thus, the nozzle 2 may be provided, for example with a cover 21 which closes an opening 22 in the nozzle 2. After removal of the cover 21 one vane or blade 7 after the other can be disassembled.

In the lower portion of FIG. 1 there is illustrated a recess or trough 23 which is closed by a closure member 24 welded thereto. For exchanging one or more propeller vanes or blades 7 the closure member 24 is cut-out, whereupon the individual propeller vanes or blades 7, by appropriately rotating the hub 3, may be placed into a position in which they may be lowered into the recess 23 and can be laterally withdrawn from the propeller hub 3.

While there are shown and described present preferred embodiments of the invention, it is to be distinctly understood that the invention is not limited thereto, but may be otherwise variously embodied and practiced within the scope of the following claims. Accordingly,

What I claim is:

1. A marine vessel propeller with nozzle through which flows water comprising:

a propeller defining a propeller axis;

vanes each defining a vane axis and each pivotable about their corresponding vane axis into a selectable predetermined angular position to form a predetermined angle of attack;

said vane axes intersecting at an intersection point located on said propeller axis;

each said vane extending to both sides of said vane axis and forming an outer edge defined by a domed outer surface;

said domed outer surface substantially forming portions of a spherical surface possessing a central point and a radius;

said central point being located at said intersection point;

said nozzle comprising an inner surface provided with a substantially spherical zone possessing a radius and a central point which is also located at said intersection point;

said radius of said spherical zone being greater than said radius of said spherical surface of said domed outer surface in order to form a predetermined gap;

said spherical zone extending upstream and downstream of a circular intersection line formed by the intersection of a surface described by said vane axes during rotation of said vanes about said propeller axis and said spherical zone;

said domed outer surface of each pivotable vane and said spherical zone of said nozzle which form therebetween said predetermined gap coacting with one another such as to maintain said predetermined gap essentially constant throughout the region of said spherical zone irrespective of the angular position assumed by said pivotable vane;

said domed outer surface of each said vane possessing ends and said spherical zone provided at said inner surface of said nozzle forming margins; and said ends and said margins substantially coinciding at the largest vane angle of attack.

2. The marine vessel propeller as efined in claim 1, wherein:

said spherical zone forms an upstream section and a downstream section extending downstream and upstream, respectively, of said circular intersection line; and said downstream section is larger than said upstream section.

3. The marine vessel propeller as defined in claim 1, wherein:

said surface described by said vane axes during rotation of said vanes forms a plane extending substantially normally with respect to said propeller axis.

4. The marine vessel propeller as defined in claim 1, wherein:

said vane axes of said vanes are inclined at an angle downstream and away with respect to a plane extending normally with respect to said propeller axis.

5. The marine vessel propeller as defined in claim 4, wherein:

said margins of said spherical zone of said nozzle include an upstream margin; and said inclination angle of said vane axes with respect to said plane extending substantially normally relative to said propeller axis is selected such that said upstream margin is located at the region of a plane extending substantially normally relative to said propeller axis and through said intersection point.

6. The marine vessel propeller as defined in claim 4, wherein:

said margins of said spherical zone of said nozzle include an upstream margin; and said inclination angle of said vane axes with respect to said plane extending substantially normaly relative to said propeller axis is selected such that said upstream margin is located upstream of a plane extending substantially normally relative to said propeller axis and through said intersection point.

7. The marine vessel propeller as defined in claim 1, wherein:

said spherical zone on said nozzle constitutes a machined surface.

8. A marine vessel propeller with nozzle through which flows water comprising:

a propeller defining a propeller axis;

vanes each defining a vane axis and each pivotable about their corresponding vane axis into a selectable predetermined angular position to form a predetermined angle of attack;

said vane axes intersecting at an intersection point located on said propeller axis;

each said vane extending to both sides of said vane axis and forming an outer edge defined by a domed outer surface;

said domed outer surface substantially forming portions of a spherical surface possessing a central point and a radius;

said central point being located at said intersection point;

said nozzle comprising an inner surface provided with a substantially spherical zone possessing a radius and a central point which is also located at said intersection point;

said radius of said spherical zone being greater than said radius of said spherical surface of said domed outer surface in order to form a predetermined gap;

said spherical zone extending upstream and downstream of intersection points formed by the intersection thereof with said vane axes when said propeller is stationary;

said domed outer surface of each pivotable vane and said spherical zone of said nozzle which form therebetween said predetermined gap coacting with one another such as to maintain said predetermined gap essentially constant throughout the region of said spherical zone irrespective of the angular position assumed by said pivotable vane;

said domed outer surface of each said vane forming ends and said spherical zone provided at said inner surface of said nozzle forming margins; and said ends and said margins substantially coinciding at the largest vane angle of attack.

9. The marine vessel propeller as defined in claim 8, wherein:

said spherical zone forms an upstream section and a downstream section extending downstream and upstream, respectively, of ssid intersection points; and said downstream section is larger than said upstream section.

10. The marine vessel propeller as defined in claim 8, wherein:

said vane axes extend substantially normally with respect to said propeller axis.

11. The marine vessel propeller as defined in claim 8, wherein:

said vane axes of said vanes are inclined at an angle downstream with respect to said propeller axis.

12. The marine vessel propeller as defined in claim 11, wherein:

said margins of said spherical zone of said nozzle include an upstream margin; and said inclination angle of said vane axes with respect to said propeller axis is selected such that said upstream margin is located at the region of a line extending substantially normally relative to said propeller axis and through said intersection point.

13. The marine vessel propeller as defined in claim 11, wherein:

said margins of said spherical zone on said nozzle include an upstream margin; and said inclination angle of said vane axes with respect to said propeller axis is selected such that said upstream margin is located upstream of a line extending substantially normally relative to said propeller axis and through said intersection point.

14. The marine vessel propeller as defined in claim 8, wherein:

said spherical zone on said nozzle constitutes a machined surface.

15. The marine vessel propeller as defined in claim 1, wherein:

said vane axis about which there is pivotable the corresponding vane being located intermediate said vane ends and intersecting said spherical zone intermediate said margins thereof; and said domed outer surface of each pivotable vane and said spherical zone of said nozzle coacting with one another such as to inhibit expansion of the flow of water through said nozzle at the region of said spherical zone.

16. The marine vessel propeller as defined in claim 1, wherein:

said nozzle is stationarily arranged relative to said pivotal vanes.

17. The marine vessel propeller as defined in claim 8, wherein:

said vane axis about which there is pivotable the corresponding vane being located intermediate said vane ends and intersecting said spherical zone intermediate said margins thereof; and said domed outer surface of each pivotable vane and said spherical zone of said nozzle coacting with one another such as to inhibit expansion of the flow of water through said nozzle at the region of said spherical zone.

18. The marine vessel propeller as defined in claim 8, wherein:

said nozzle is stationarily arranged relative to said pivotal vanes.

* * * * *

UNITED STATES PATENT AND TRADEMARK OFFICE

CERTIFICATE OF CORRECTION

PATENT NO. : 4,509,925

DATED : April 9, 1985

INVENTOR(S) : Wolfgang Wührer

It is certified that error appears in the above—identified patent and that said Letters Patent is hereby corrected as shown below:

Column 3, line 16, at the end of the line please delete "one" and insert --zone--

Column 6, line 3, please delete "efined" and insert --defined--

Column 6, line 38, please delete "normaly" and insert --normally--

Column 7, line 24, please delete "ssid" and insert --said--

Signed and Sealed this

*Seventeenth* Day of *September 1985*

[SEAL]

*Attest:*

*Attesting Officer*

DONALD J. QUIGG

*Commissioner of Patents and Trademarks—Designate*